US008844443B2

(12) United States Patent
Tomov

(10) Patent No.: US 8,844,443 B2
(45) Date of Patent: Sep. 30, 2014

(54) SPIN OR AERODYNAMICALLY STABILIZED AMMUNITION

(76) Inventor: Lubomir Mihaylov Tomov, Simeonovo (BG)

( * ) Notice: Subject to any disclaimer, the term of this patent is extended or adjusted under 35 U.S.C. 154(b) by 109 days.

(21) Appl. No.: 13/560,770

(22) Filed: Jul. 27, 2012

(65) Prior Publication Data

US 2014/0077024 A1 Mar. 20, 2014

(30) Foreign Application Priority Data

Jan. 28, 2010 (BG) ..... 110591
Oct. 12, 2010 (WO) ..... PCT/BG2010/000017

(51) Int. Cl.
*F42B 10/30* (2006.01)
*F42B 10/34* (2006.01)
*F42B 33/00* (2006.01)
*F42B 10/26* (2006.01)

(52) U.S. Cl.
CPC ..... *F42B 10/30* (2013.01); *F42B 10/26* (2013.01); *F42B 33/00* (2013.01); *F42B 10/34* (2013.01)
USPC ..... 102/490; 244/3.23; 86/54

(58) Field of Classification Search
USPC ..... 102/439, 490, 503; 244/3.23; 60/770; 86/54
See application file for complete search history.

(56) References Cited

U.S. PATENT DOCUMENTS 16,076 A * 11/1856 Taggart ..... 244/3.23
962,482 A * 6/1910 Wells ..... 244/3.23
1,201,263 A * 10/1916 Coyle ..... 244/3.23
1,285,599 A * 11/1918 Bennett ..... 244/3.23
2,405,415 A * 8/1946 Eksergian ..... 244/3.23
2,661,692 A * 12/1953 Vegren ..... 60/201
4,301,736 A * 11/1981 Flatau et al. ..... 102/503
4,436,035 A * 3/1984 Strandli ..... 102/364
4,827,847 A * 5/1989 Laviolette et al. ..... 102/503
4,882,997 A * 11/1989 Baxter et al. ..... 102/503
4,936,218 A * 6/1990 Wosenitz ..... 102/503
4,995,318 A * 2/1991 Stidston et al. ..... 102/503
5,067,406 A * 11/1991 Olson et al. ..... 102/374
5,111,657 A * 5/1992 Hivert et al. ..... 60/224
5,544,586 A * 8/1996 Huerta ..... 102/374
6,405,653 B1 * 6/2002 Miskelly ..... 102/374
7,360,491 B2 * 4/2008 Sanborn ..... 102/510
2008/0072782 A1 * 3/2008 Salignon et al. ..... 102/503

* cited by examiner

*Primary Examiner* — Bret Hayes

(74) *Attorney, Agent, or Firm* — John K. Buche; Buche & Associates, P.C.

(57) ABSTRACT

Disclosed is spin-stabilized ammunition for use in grooved or smooth bore handheld firearms with calibers up to 60 mm. The projectile of the ammunition features a body in the shape of a truncated cone at the top of a cylinder with proportions of the cone length to the cylinder length varying between from one-to-six to one-to-three depending on the expected initial speed of the projectile after the ammunition has been discharged. A central longitudinal barrel extends through the projectile with a proportion of the entrance diameter and exit diameter of 1.38-to-one for expected discharge speeds near sound velocity or of 1.22-to-one for expected discharge of hypersonic velocities. Finally, nozzles within the projectile create a spinning motion around the projectile's axis, the nozzles being located between cavities for propellant charges.

11 Claims, 1 Drawing Sheet

SPIN OR AERODYNAMICALLY STABILIZED AMMUNITION

CROSS-REFERENCE TO RELATED APPLICATIONS

This application claims the priority of Patent Cooperation Treaty (PCT) Application No. PCT/BG2010/000017 (filed Oct. 12, 2010 with the European patent office), which PCT application claims priority to Bulgarian patent application no. BG 110591 (filed Jan. 28, 2010).

STATEMENT REGARDING FEDERALLY SPONSORED RESEARCH OR DEVELOPMENT

Not applicable.

BACKGROUND OF THE INVENTION

1. Field of Invention

This description of preferred embodiments of an invention relates to aerodynamically stabilized ammunition that can be used in grooved or smooth-bore handheld firearms with calibers up to 60 mm.

2. Background of the Invention

Up to now, ammunition has been aerodynamically stabilized via either: (a) projection from firearms with grooved barrels of various calibers and purposes (said firearms including but not limited to: guns, carbines, sub-machine-guns, and machine-guns); or (b) projection from hunting or police firearms with smooth-barrels plus application of the principle of gas pressure created as a result of ignition of various types and qualities of gunpowder or other explosive materials. The aerodynamic stabilization of rectilinear motion of such heretofore known ammunition is achieved through centrifugal forces created during the rotation of the ammunition around an axis of rotation. In grooved barrel firearms, said rotation is caused by friction between the bullet and the grooves of the barrel. In smooth barrel firearms, said rotation is caused by external plastic concentrators or stabilizers.

SUMMARY OF THE INVENTION

In view of the foregoing, it is an object of the present invention to provide ammunition for firearms that may be aerodynamically stabilized without the need for grooved barrels or external stabilizers/concentrators. In one preferred embodiment, aerodynamically stabilized ammunition comprises: a projectile defined by a truncated cone at one end of a cylinder, wherein the proportion of the axial length of the truncated cone and the axial length of the cylinder is in a range of between 1 to 6 (1:6) and 1 to 3 (1:3); an axial barrel through the cone and cylinder along the axes of rotation, the barrel having a first end at a tip of the truncated cone and a second end at back of the cylinder, and wherein the proportion of a diameter of the first end to a diameter of the second end is either (a) approximately 1.38 to 1 (1.38:1) for a predicted velocity of the projectile that is near sound velocity or (b) approximately 1.22 to 1(1.22:1) for a predicted velocity of the projectile that is hypersonic; a first cavity for a first explosive charge that is disposed in the truncated cone between an outer wall of the con and the barrel; a second cavity for a second explosive charge that is disposed in the cylinder between an outer wall of the cylinder and the barrel; and, nozzles that provide fluid communication between the first and second cavities for the creation of a spinning motion of the projectile around said axes of the truncated cone whenever one of said first and second explosive charges are discharged.

In one mode of operation, the disclosed ammunition has the advantage of aerodynamic stabilization of rectilinear motion. Suitably, said stabilization may be maintained via aerodynamic forces created as a result of the motion of the ammunition in the ambient gas (in this case the ambient is the earth's atmosphere) and acting throughout the ammunition's whole flight rather than forces created via a grooved muzzle or external plastic concentrators/stabilizers. Suitably, with the presently disclosed ammunition, the projectile achieves spinning motion as a result of the action of jet force at the moment of acceleration or ignition that are transformed into kinetic energy of the projectile without substantial energy loss.

BRIEF DESCRIPTION OF THE FIGURES

The manner in which these objectives and other desirable characteristics can be obtained is explained in the following description and attached figures in which.

It is to be noted, however, that the appended figures illustrate only typical embodiments of the disclosed assemblies, and therefore, are not to be considered limiting of their scope, for the disclosed assemblies may admit to other equally effective embodiments that will be appreciated by those reasonably skilled in the relevant arts. Also, figures are not necessarily made to scale.

DETAILED DESCRIPTION OF PREFERRED EMBODIMENTS

In general, disclosed is an ammunition projectile that is aerodynamically stabilized by rotation caused by either (a) jet forces created by the configuration of cavities containing an explosive for accelerating the projectile or (b) aerodynamic forces resulting from the interaction of ambient gasses and a tapering barrel through the projectile as it moves through the ambient gasses. The more specific aspects of the ammunition and related projectile are disclosed in connection with the figures.

Figure 2:
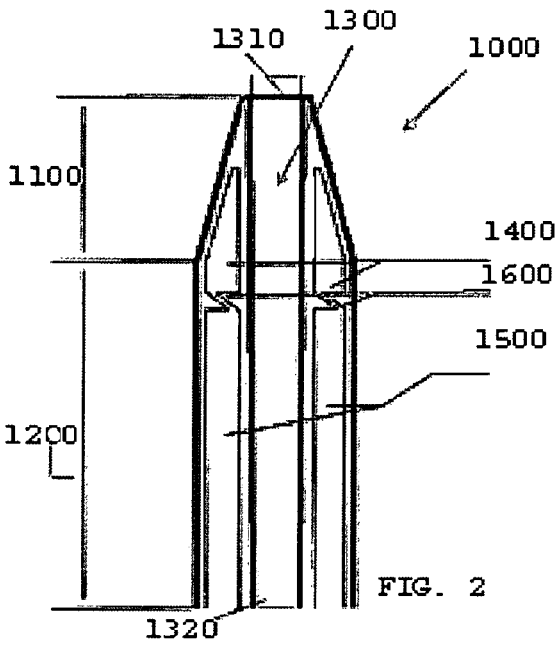
FIG. 2 is a cross section of the round of ammunition of FIG. 1.
Figure 1:
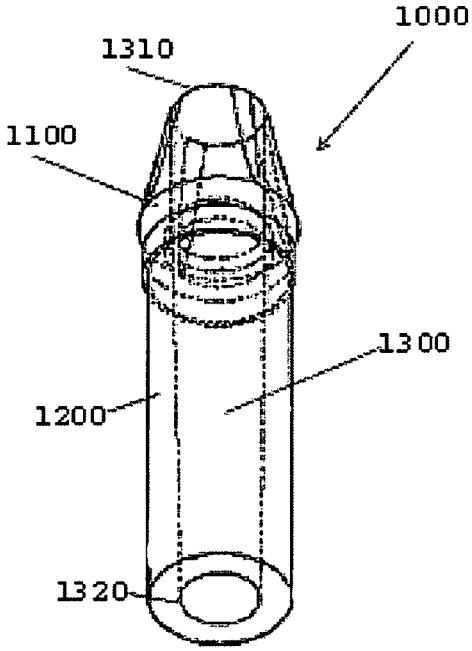
FIG. 1 is a perspective view of a round of ammunition.
Figure 3:
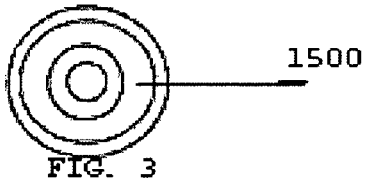
FIG. 3 is a bottom view of the round of ammunition of FIGS. 1 and 2.

FIG. 1 is a perspective view of a spin-stabilized ammunition 1000. FIG. 2 is a cross section of the ammunition of FIG. 1. FIG. 3 is a bottom view of the ammunition 1000 of FIGS. 1 and 2. As shown in the figure, the ammunition defines a projectile comprising: a truncated cone 1100; a cylinder 1200; a barrel 1300 through the cone and cylinder; a first cavity 1400 for first explosive charge disposed in the cone 1100; a second cavity 1500 for a second explosive charge; and a nozzle 1600 between the first and second cavities.

As shown in FIGS. 1 through 3, the projectile 1000 is generally defined by the truncated cone 1100 being positioned at one end of the cylinder 1200, wherein the proportion of the axial height of the truncated cone 1200 and the axial height of the cylinder 1300 is in a range of between one to six (1:6) and one to three (1:3). Still referring to the identified figures, the projectile 1000 preferably features an axial barrel 1300 through the cone 1200 and cylinder 1200 along the axes thereof. In one embodiment, the barrel 1300 suitably defines a hollow portion of the projectile 1000 so that a first end 1310 of the barrel is located at a tip of the truncated cone 1100 and a second end 1320 is located at opposite end of the cylinder

1200. In one preferred embodiment, the proportion of a diameter of the first end 1310 to a diameter of the second end 1320 is either (a) approximately one and thirty-eight hundredths to one (1.38:1) for a predicted velocity of the projectile that is near sound velocity or (b) approximately one and twenty-two hundredths to one (1.22:1) for a predicted velocity of the projectile that is hypersonic.

Referring now to FIG. 2, the first cavity 1400 for a first explosive charge may be disposed in the truncated cone between an outer wall of the cone 1100 and the barrel 1300. As shown in FIGS. 2 and 3, the second cavity 1500 for a second explosive charge is suitably disposed in the cylinder 1200 between an outer wall of the cylinder 1200 and the barrel 1300 so that it is open around the second end 1320 of the barrel 1300 (see FIG. 3). Referring back to FIG. 2, the projectile 1000 preferably features nozzles 1600 that provide fluid communication between the first and second cavities 1400, 1500 for the creation of a spinning motion of the projectile around said axes of the truncated cone whenever at least one of said first and second explosive charges are discharged.

In one mode of operation, the aerodynamically stabilized projectile 1000 achieves stable rectilinear motion through aerodynamic forces created as a result of the specific shape of its body, the axial barrel, and the centripetal forces created by discharge of the explosives in the cavities. Suitably, said features cause a spinning motion or rotation of the projectile around its lengthwise axis. In one embodiment, part of the exhaust created by the ignition of the first explosive charge is expelled through the nozzles 1600 to create said spinning motion of the projectile, which compensates for asymmetries in the body and barrel which may or may not be the result of technological deficiencies or error tolerances of machining processes during manufacture.

It should be noted that FIGS. 1 through 3 and the associated description are for illustrative purposes only. In other words, the depiction and descriptions of the present invention should not be construed as limiting of the subject matter in this application. Additional modifications and variations within the scope of the invention may become apparent to one skilled in the art after reading this disclosure.

I claim:

1. A projectile that is aerodynamically stabilized, wherein the projectile comprises:

a truncated cone atop a cylinder so that the cone and cylinder share an axis;

a barrel through the cone and cylinder, said barrel (a) centrally positioned through the shared axis of the cone and cylinder and (b) featuring a first end with a first diameter and a second end with a second diameter wherein the diameter at the first end is greater than the diameter at the second end;

a first chamber for a first explosive charge, said chamber defined within the cone between an outer wall of the cone and the barrel;

a second chamber for a second explosive charge, said second chamber defined within the cylinder between an outer wall of the cylinder and the barrel; and a nozzle that is located at the top of the cylinder between the outer wall of the cylinder and the barrel, said nozzle for providing fluid communication between the first and second chambers, said nozzle configured to enact rotation of the projectile around the axis whenever said first explosive charge is discharged.

2. The projectile of claim 1 wherein a ratio of an axial length of the truncated cone and an axial height of the cylinder is in a range of between one to six (1:6) and one to three (1:3).

3. The projectile of claim 1 wherein the proportion of the first diameter and the second diameter is approximately one and thirty-eight hundredths to one (1.38:1).

4. The projectile of claim 1 wherein the proportion of the first diameter to the second diameter is approximately one and twenty-two hundredths to one (1.22:1).

5. The projectile of claim 2 wherein the proportion of the first diameter to the second diameter is approximately one and twenty-two hundredths to one (1.22:1).

6. A method of stabilizing flight of a projectile comprising the steps of:

locating a projectile comprising a) a truncated cone atop a cylinder so that the cone and cylinder share an axis, b) a barrel through the cone and cylinder, said barrel (a) centrally positioned through the shared axis of the cone and cylinder and (b) featuring an entrance with a first diameter and an exit with a second diameter wherein the diameter at the entrance is greater than the diameter at the exit, c) a first chamber for a first explosive charge, said chamber defined within the cone between an outer wall of the cone and the barrel, d) a second chamber for a second explosive charge, said second chamber defined within the cylinder between an outer wall of the cylinder and the barrel, and, e) a nozzle that is located at the top of the cylinder between the outer wall of the cylinder and the barrel, said nozzle for providing fluid communication between the first and second chambers, said nozzle configured to enact rotation of the projectile around the axis whenever said first explosive charge is discharged;

discharging said second explosive charge to enact linear motion of the projectile;

discharging said first explosive charge so that gasses are passed through the vent into the second chamber to enact rotation of the projectile around the axis passing gasses into the entrance of the barrel provided through the projectile; and passing the gasses out of an exit of the barrel;

discharging an explosive charge, said chamber defined within the cone between an outer wall of the cone and the barrel;

passing gasses into a second chamber for another explosive charge, said second chamber defined within the cylinder between an outer wall of the cylinder and the barrel; and, passing gasses into a nozzle that is located at the top of the cylinder between outer wall of the cylinder and the barrel, said nozzle for providing fluid communication between the first and second chambers, said nozzle for providing fluid communication between the first and second chambers, said nozzle configured to enact rotation of the projective around the lengthwise axis whenever said first explosive charge is discharged.

7. The method of claim 5 wherein a proportion of the first diameter to the second diameter is approximately one and thirty-eight hundredths to one (1.38:1).

8. The method of claim 5 wherein the proportion of the first diameter to the second diameter is approximately one and twenty-two hundredths to one (1.22:1).

9. A method of constructing a projectile comprising the steps of:

locating a projectile comprising a truncated cone atop a cylinder so that the cone and cylinder share an axis;

providing barrel through the projectile along the shared axis of the cone and cylinder, said barrel with an entrance having a first diameter and an exit having a second diameter that is smaller than the first diameter;

providing a first chamber for a first explosive charge, said chamber defined within the cone between an outer wall of the cone and the barrel;

providing a second chamber for a second explosive charge, said second chamber defined within the cylinder between an outer wall of the cylinder and the barrel.

10. The method of claim 9 wherein the proportion of the first diameter to the second diameter is approximately one and thirty-eight hundredths to one (1.38:1).

11. The method of claim 9 wherein the proportion of the first diameter to the second diameter is approximately one and twenty-two hundredths to one (1.22:1).

* * * * *